US008136323B2

(12) United States Patent
King

(10) Patent No.: US 8,136,323 B2
(45) Date of Patent: Mar. 20, 2012

(54) PANEL FOR USE IN A SIDING SYSTEM FOR PROVIDING A DECORATIVE COVERING ON A SUPPORT SURFACE

(75) Inventor: Daniel W. King, Copley, OH (US)

(73) Assignee: Tapco International Corporation, Wixom, MI (US)

( * ) Notice: Subject to any disclaimer, the term of this patent is extended or adjusted under 35 U.S.C. 154(b) by 581 days.

(21) Appl. No.: 12/188,349

(22) Filed: Aug. 8, 2008

(65) Prior Publication Data

US 2009/0038252 A1 Feb. 12, 2009

Related U.S. Application Data

(60) Provisional application No. 60/955,163, filed on Aug. 10, 2007.

(51) Int. Cl.
*E04D 1/00* (2006.01)

(52) U.S. Cl. ..... 52/524; 52/542; 52/544; 52/553

(58) Field of Classification Search ..... 52/518, 52/519, 520, 522, 524, 525, 526, 529, 536, 52/539, 542, 543, 544, 545, 546, 553, 554, 52/555, 557

See application file for complete search history.

(56) References Cited

U.S. PATENT DOCUMENTS 2,918,996 A * 12/1959 Brown ..... 52/522
3,188,774 A 6/1965 McCorkle
3,226,901 A 1/1966 Harter
3,233,382 A * 2/1966 Graveley, Jr. ..... 52/522
3,289,365 A * 12/1966 Mclaughlin et al. ..... 52/515
3,325,952 A 6/1967 Trachtenberg
3,417,531 A 12/1968 Jones
3,473,274 A 10/1969 Godes
3,593,479 A 7/1971 Hinds et al.
3,621,625 A 11/1971 Medow
3,968,610 A 7/1976 Medow
4,258,520 A 3/1981 Rehbein
4,261,152 A 4/1981 Tellman
4,348,849 A 9/1982 Wollam et al.
4,522,002 A 6/1985 Davis et al.
4,649,008 A 3/1987 Johnstone et al.
4,656,722 A 4/1987 Armstrong
4,864,787 A 9/1989 Bukowski
4,947,609 A 8/1990 Champagne
5,012,623 A 5/1991 Taylor
5,022,207 A 6/1991 Hartnett
5,072,562 A 12/1991 Crick et al.

(Continued)

*Primary Examiner* — Jessica Laux
(74) *Attorney, Agent, or Firm* — Quinn Law Group, PLLC

(57) ABSTRACT

The present invention relates to a siding system for covering a support surface comprising a panel including a body presenting a plane and having a top edge and a bottom edge. The body has a first locking element presenting a nailing hem and a second locking element for spacing the bottom edge of the body from the support surface. The panel has a spacer interconnecting the first locking element and the body of the panel for spacing the top edge of the body from the support surface such that the plane is substantially parallel to the support surface. Additionally, the siding system includes a second panel substantially similar to the first panel such that the second panel interlocks with the first panel. The cooperation of the spacer and the second locking element results in the alignment of the plane of the first panel with the plane of the second panel such that both planes are substantially parallel to the support surface.

27 Claims, 5 Drawing Sheets

U.S. PATENT DOCUMENTS 5,349,802 A 9/1994 Kariniemi
5,388,381 A 2/1995 Bilinski et al.
5,651,227 A 7/1997 Anderson
5,675,955 A 10/1997 Champagne
5,694,728 A * 12/1997 Heath et al. ..... 52/554
5,829,206 A 11/1998 Bachman
5,878,543 A 3/1999 Mowery
6,874,290 B1 * 4/2005 Bokan ..... 52/543
7,040,067 B2 * 5/2006 Mowery et al. ..... 52/519
2004/0003566 A1 1/2004 Sicuranza
2004/0159062 A1 * 8/2004 Donlin et al. ..... 52/506.01
2006/0026919 A1 * 2/2006 Morse et al. ..... 52/506.01

* cited by examiner

PANEL FOR USE IN A SIDING SYSTEM FOR PROVIDING A DECORATIVE COVERING ON A SUPPORT SURFACE

RELATED APPLICATIONS

This application claims priority to and all advantages of U.S. Provisional Patent Application No. 60/955,163, which was filed on Aug. 10, 2007 and is incorporated by reference.

FIELD OF THE INVENTION

The present invention relates to a siding system for providing a decorative covering on a support surface such as on a wall of a building.

BACKGROUND OF THE INVENTION

There are various methods of covering, protecting, and decorating an exterior surface of a building known in the art. For example, the construction of a brick or a stone wall against the exterior surface of the building is popular with consumers. However, the construction of the brick or the stone wall can be expensive as compared to other methods.

Siding systems have been used for decades as an alternative to the brick or the stone wall construction. Generally, siding systems are less expensive to construct than the brick or the stone wall method. Typically, the siding systems include a plurality of panels with the panels disposed adjacent to one another for covering the support surface of the building.

Additionally, it is known in the art for the panels to include a decorative element for aesthetic purposes, such as a patterned face that may resemble a brick or a stone wall. Typically, in the siding system resembling a brick or a stone wall, adjacent panels engage each other to assist in securing the panels to the support surface. For example, it is known in the art for the panels to define a pair of pockets and have a pair of tabs. The tabs of the panels are disposed within the pockets of an adjacent panel that is secured to the support surface. Generally, the tabs simply rest within the pockets without providing an interlocking mechanism to secure the tabs within the pockets. An example of a siding system resembling the brick or the stone wall is in U.S. Pat. No. 3,968,610. The lack of the locking mechanism may result in the separation of the panels from each other when subjected to a force, such as wind, thereby requiring additional maintenance to monitor and re-secure the panels to each other and/or the support surface.

Alternatively, siding systems without the aesthetic appearance of a stone or a brick wall are known in the art. The panels of these systems typically include a first tab and a second tab each having a complementary configuration to each other. The second tab of one of the panels interlocks with the first tab of the other panel, generally by lifting the bottom edge of one of the panels vertically, as the panels are mounted to the support surface. The interlocking of the first tab with the second tab requires that vertically adjacent panels overlap each other in a stepped configuration. A general example of a siding system having a first tab and a second tab is U.S. Pat. No. 5,675,955. Although the interlocking of the first tab and the second tab provides a secure engagement between adjacent panels, the overlapping of vertically adjacent panels prevents the siding system from resembling a brick or a stone wall.

Furthermore, it is known in the art for siding systems to utilize a plurality of wall brackets mounted to the support surface as an intermediary for securing the panel to the support surface. Typically, the wall brackets include at least one first tab and the panels include at least one second tab having a complementary configuration to the first tab. The panels are disposed on the wall brackets for securing the panels to the support surface. Generally, a first wall bracket and a second wall bracket are mounted to the support surface spaced from each other, such that the second tabs of the panels interlocks with the first tabs of the wall brackets. The panels are disposed on the wall brackets by pressing the panels toward the support surface to snap the second tabs of the panels into the first tabs of the wall brackets. An example of a siding system using wall brackets can be seen in U.S. Pat. No. 6,874,290. However, utilizing the wall brackets require an additional step of mounting the wall brackets to the support surface before the panels can be secured to the support surface resulting in more complex process as compared to siding systems without the wall brackets. The increase complexity results in additional time to install the siding system.

Therefore, there remains a need to provide a siding system that emulates a brick or stone wall that has a strong interlocking connection between adjacent panels to resist separation while minimizing the complexity of construction to reduce installation time.

SUMMARY OF THE INVENTION AND ADVANTAGES

The present invention provides a panel for use in a siding system to cover a support surface with the siding system including a second panel. The panel has a body having opposing top and bottom edges and defining a plane. The panel also has a first locking element integrally formed with the body and interconnected to the top edge of the body for engaging with the second panel. The panel further includes a second locking element integrally formed with the body and attached to the bottom edge of the body for spacing the bottom edge of the body from the support surface. The panel also includes a spacer integrally formed with and interconnecting the first locking element and the body for spacing the top edge of the body from the support surface such that the plane is substantially parallel with the support surface.

Therefore, the present invention provides a panel for use in a siding system that can be mounted to a support surface in a substantially parallel relationship to the support surface for emulating a brick wall or a stone wall. Additionally, the panel of the present invention provides a strong interlocking connection when coupled to a second panel such that the interlocking connection prevent the panels from separating while still allowing the panels to present a flush appearance for emulating the brick wall or the stone wall.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION OF THE INVENTION

Figure 1:
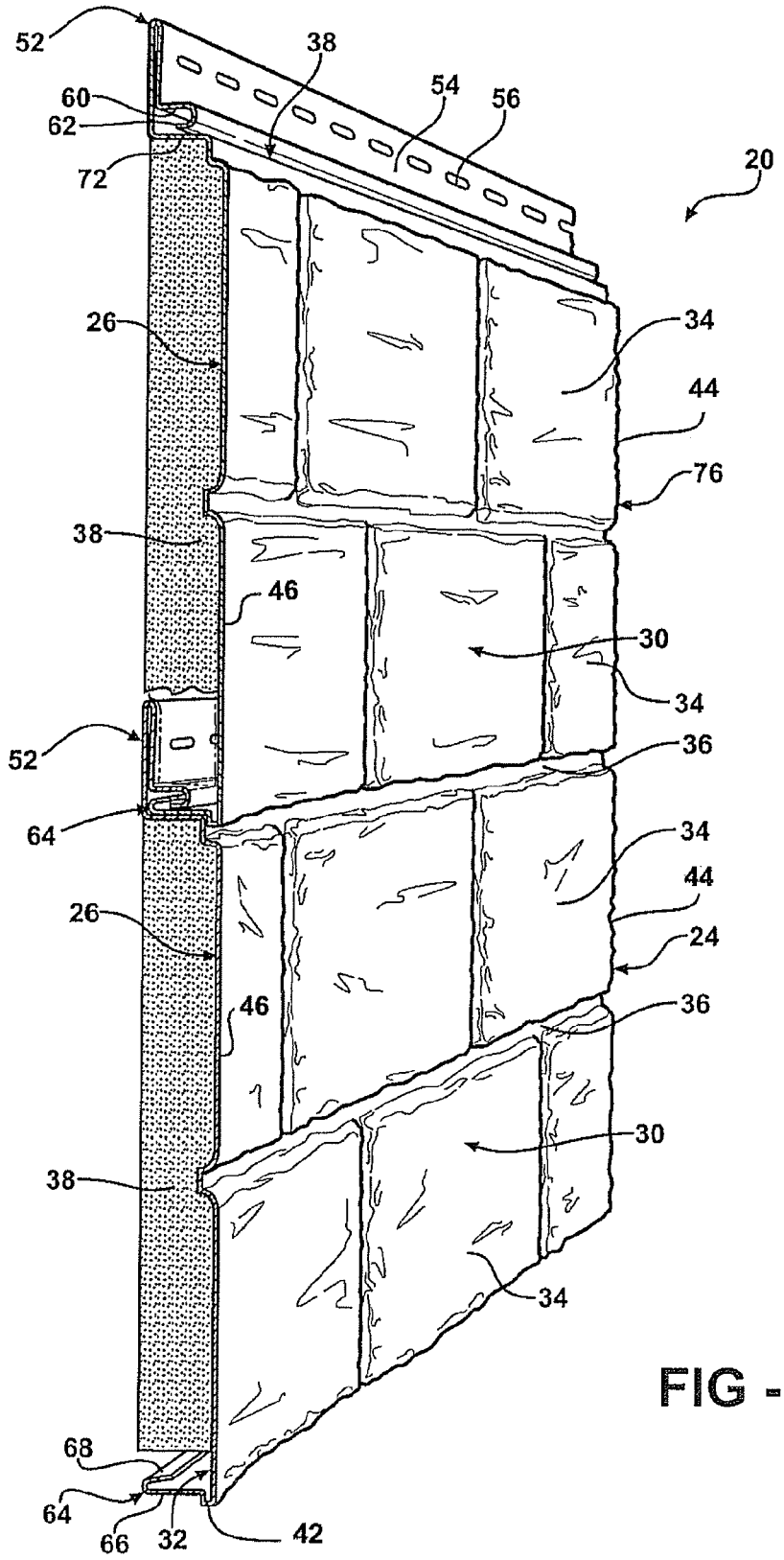
FIG. 1 is a front perspective and cross-sectional view of a siding system having a first panel and a second panel.
Figure 2:
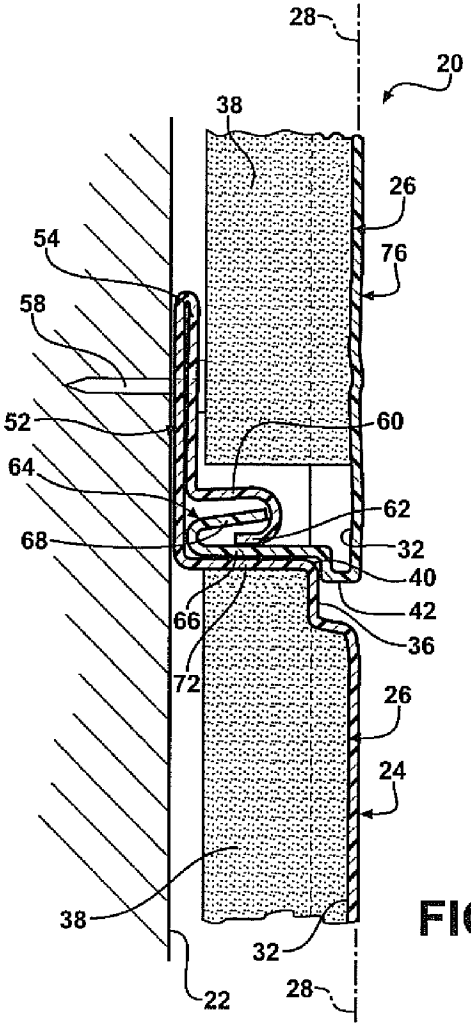
FIG. 2 is an enlarged cross-sectional view of the first panel of FIG. 1 secured to a support surface with the second panel interlocked with the first panel.

Referring to the Figures, wherein like numerals indicate like or corresponding parts throughout the several views, a siding system 20 for covering a support surface 22 is shown in FIGS. 1 and 2. Generally, the siding system 20 may be disposed on at least one exterior wall of a building or the like. However, it is to be appreciated that the siding system 20 may be disposed on other surfaces, such as at least one interior wall or at least one interior ceiling of the building.

The siding system 20 includes a panel 24. Typically, the panel 24 comprises a rigid thermoplastic material, such as polyvinylchloride or "vinyl" however, it is to be appreciated that the panel 24 may comprise other suitable materials without departing from the nature of the present invention. Generally, the panel 24 is integrally formed such that the panel 24 is a unitary sheet of the rigid thermoplastic material having a uniform thickness.

The panel 24 has a body 26 defining a plane 28 and presenting a decorative face 30 opposed by a rear face 32 such that the rear face 32 is adjacent to the support surface 22 when the panel 24 is mounted to the support surface 22. Typically, the decorative face 30 defines a plurality of decorative elements 34 that cooperate to resemble a brick wall or a stone wall. However, it is to be appreciated that the decorative elements 34 may simulate other building materials, such as shake shingle siding. Typically, the decorative elements 34 are raised from the decorative face 30 such that the decorative elements 34 adjacent to each other define a void 36 therebetween. The void 36 are configured to resemble grout lines which are known in the art of brick wall or stone wall construction.

The panel 24 may include a backing element 38 disposed on the rear face 32 of the body 26 such that the backing element 38 is between the body 26 and the support surface 22 when the panel 24 is mounted to the support surface 22 for providing additional rigidity to the panel 24 and for insulating the support surface 22. It is to be appreciated that the backing element 38 may comprise any suitable material. Typically, a suitable material is a material that imparts structural rigidity to the panel and/or adds insulative value to the panel 38 such as a foam, a composite, a wood, etc. Suitable foams for purposes of the present invention include but are not limited to polystyrene foams (EPS and XPS), polyurethane foams, etc. It is to be further appreciated that, when present the backing element 38 may cover the entire rear face 32 or only a portion of the rear face 32 without departing from the nature of the present invention.

The body 26 of the panel 24 also has opposing top and bottom edges 40, 42 such that the body 26 of the panel 24 is disposed between the top edge 40 and the bottom edge 42. The body 26 further includes a right end 44 and a left end 46 such that the body 26 of the panel 24 is disposed between the right end 44 and the left end 46. The terms top, bottom, left and right are used herein for exemplary purposes and are not intended to be limiting. Typically, the body 26 has a rectangular configuration, however, it should be appreciated that the body 26 may resemble other configurations, such as a square or a trapezoid or any acceptable configuration known to those of ordinary skill in the art.

Figure 3:
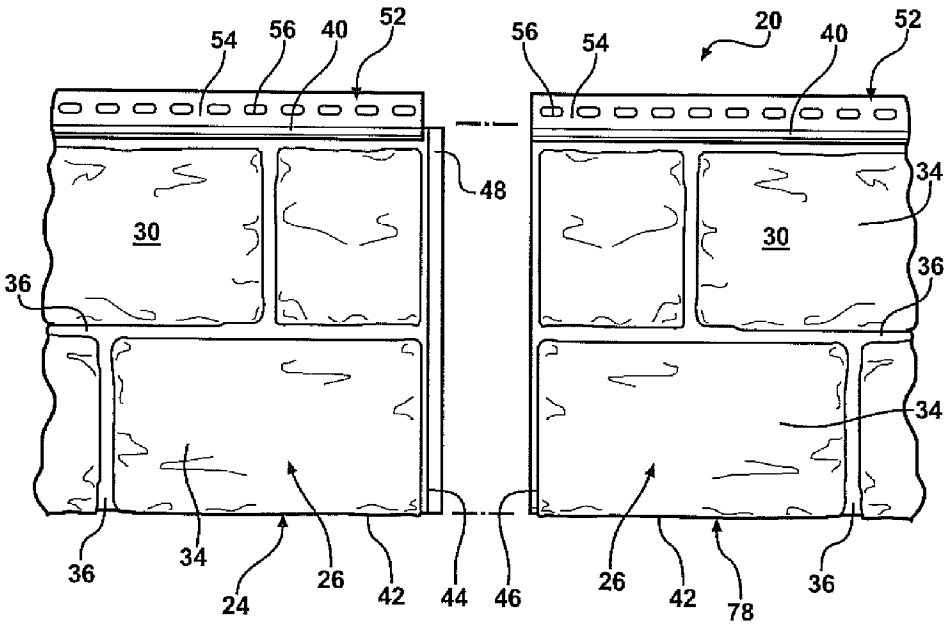
FIG. 3 is a front view of the first panel of FIG. 1 having an overlapping portion and a third panel spaced from the first panel prior to disposing the third panel over the first panel.
Figure 4:
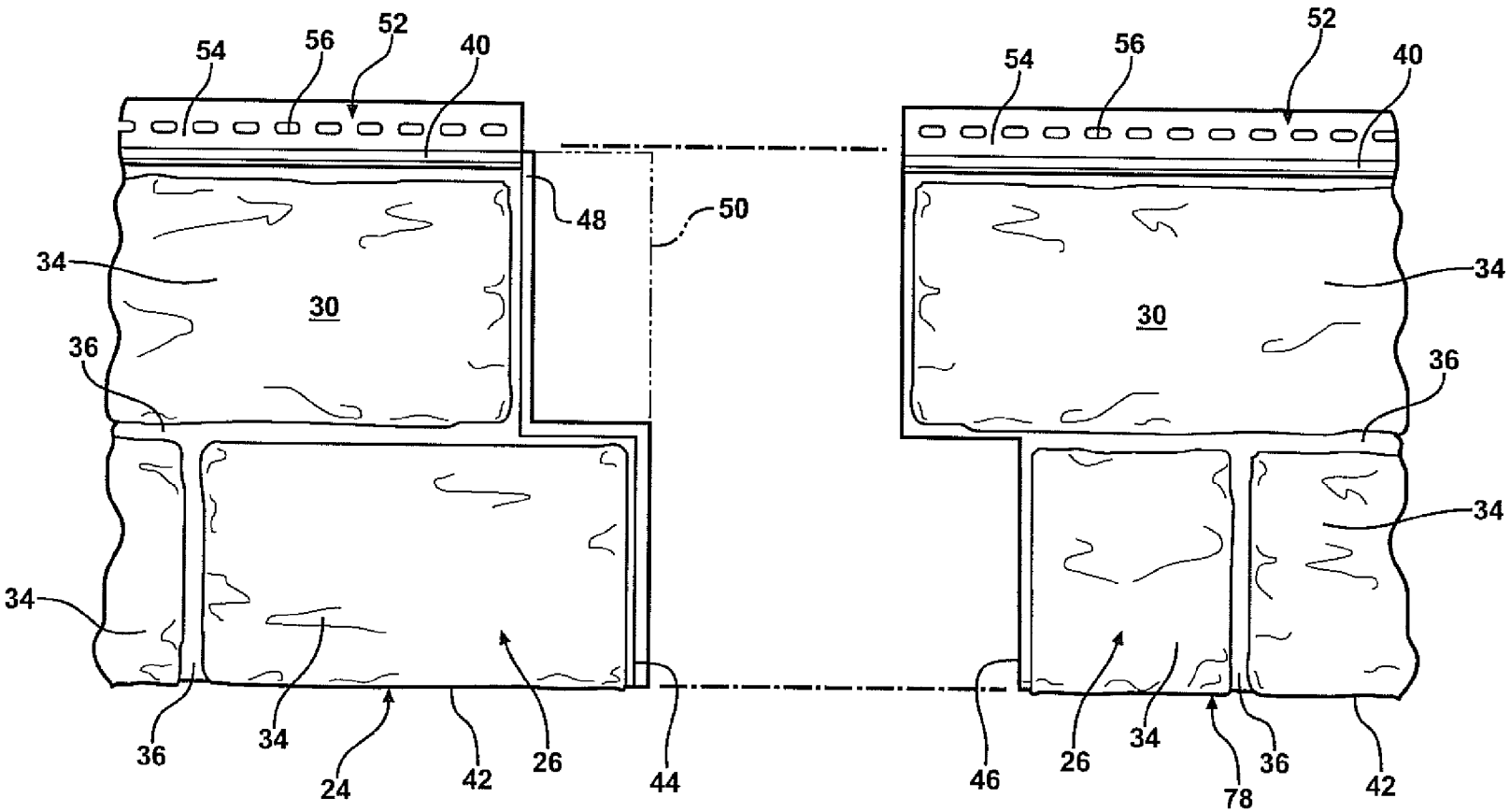
FIG. 4 is a front view of an alternative embodiment of the first panel of FIG. 1 with the overlapping portion defining a cutout to present a staggered appearance and the third panel spaced from the first panel prior to disposing the third panel over the first panel.

Referring to FIG. 3, the panel 24 further includes an overlapping portion 48 extending from the body 26 of the panel 24. Typically, the overlapping portion 48 extends from the right end 44 of the body 26. The overlapping portion 48 is recessed from the decorative face 30 and configured to compliment the rear face 32 of the panel 24. As shown in FIG. 4, it is to be appreciated that the overlapping portion 48 may define a first cutout 50 to give the overlapping portion 48 a staggered appearance.

Referring back to FIGS. 1 and 2, the panel 24 also has a first locking element generally shown at 52 in the Figures. As best shown in FIG. 2, the first locking element 52 is integrally formed with the body 26 and interconnected to the top edge 40 of the body 26. Typically, the first locking element 52 has a portion that is substantially parallel with the plane 28 and presents a nailing hem 54. The nailing hem 54 of the first locking element 52 is offset from the plane 28 and defines a plurality of holes 56 for receiving a plurality of fasteners 58 to secure the panel 24 to the support surface 22. Referring only to FIG. 2, typically, the nailing hem 54 is formed by folding the rigid thermoplastic material back on itself thereby doubling the thickness of the panel 24 at the nailing hem 54. However the nailing hem 54 may be formed by a single layer of the rigid thermoplastic material. The holes 56 may be horizontally elongated for increasing the installation area of the fasteners 58 to the support surface 22 and for allowing the thermal expansion of the panel 24 without causing the panel 24 to buckle.

The first locking element 52 also includes a first arm 60 having a length and disposed between and transverse to the plane 28 and the nailing hem 54. The first arm 60 has a first finger 62 such that the first arm 60 and the first finger 62 cooperate to present a general hook-shaped configuration. The first arm 60 has a normal position and a biased position which will be discussed in greater detail below.

Figure 5:
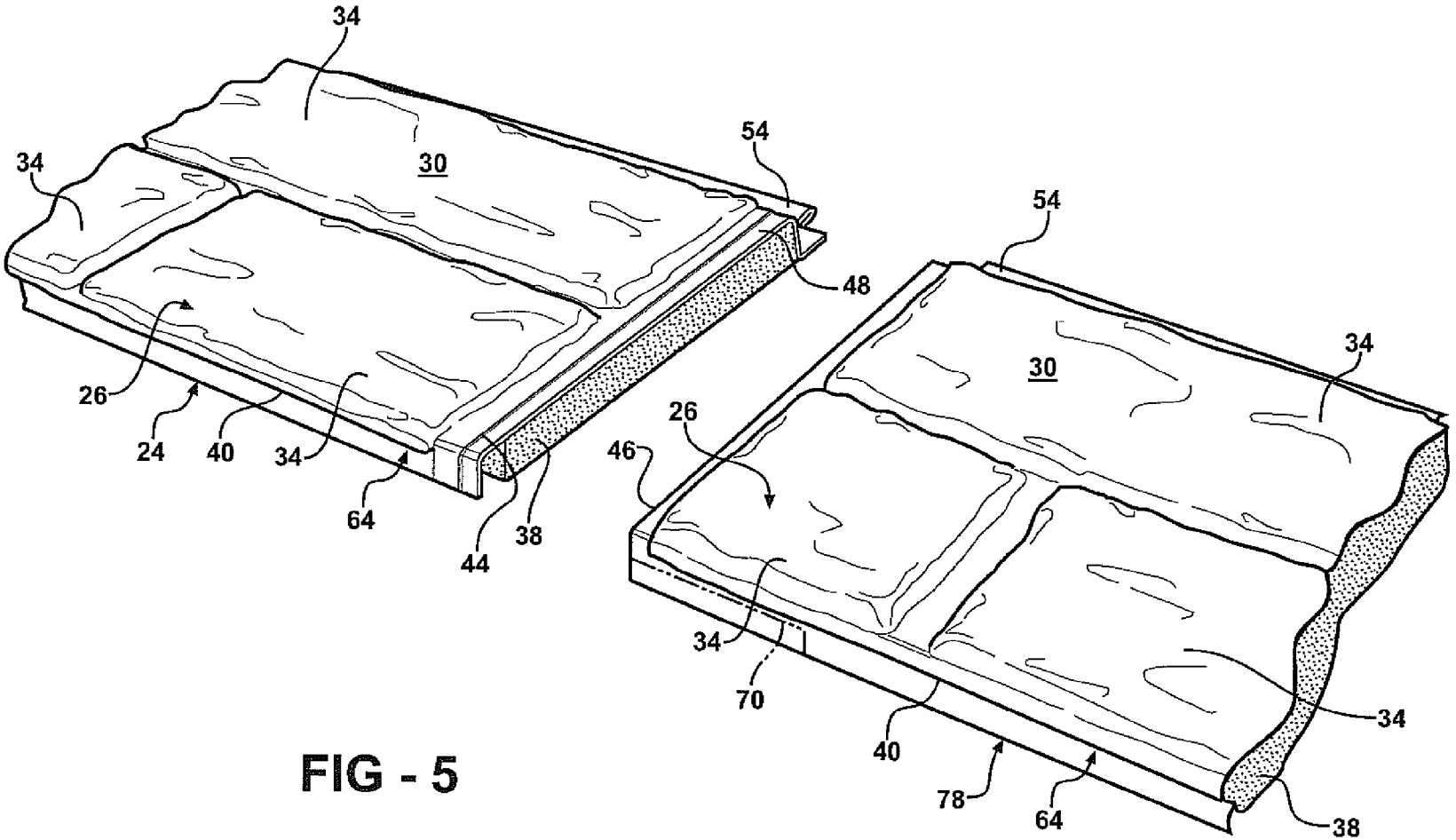
FIG. 5 is a front perspective view of the first panel of FIG. 1 having a second locking element and spaced from the third panel prior to disposing the third panel over the first panel.

The panel 24 further includes a second locking element generally shown at 64 in the Figures. As best shown in FIG. 2, the second locking element 64 has a length and is integrally formed with the body 26 and attached to the bottom edge 42 of the body 26 for spacing the bottom edge 42 of the body 26 from the support surface 22. The second locking element 64 is transverse to the plane 28 and extends from the rear face 32 of the panel 24. The second locking element 64 has a second arm 66 having a second finger 68 with the second arm 66 and the second finger 68 cooperating to present a complementary configuration to the first arm 60 and the first finger 62. Said differently, the second aim 66 with the second finger 68 together present a general hook-shaped configuration which complements the general hook-shaped configuration of the first arm 60 and the first finger 62. Typically, the second arm 66 is spaced a distance D from the bottom edge 42 of the panel 24. However, the second arm 66 may be aligned with the bottom edge 42 of the panel 24 without deviating from the subject invention. Referring to FIG. 5, the second locking element 64 may define a second cut out 70 adjacent to the left end 46 which will be discussed in detail below.

Referring again to FIGS. 1 and 2, typically, the first locking element 52 and the second locking element 64 are continuous along the panel 24. However, it is to be appreciated that the panel 24 may have a plurality of first locking elements 52 spaced from each other along the panel 24 or a plurality of second locking elements 64 spaced from each other along the panel 24 such that the second locking elements 64 vertically align with the first locking elements 52.

Figure 6A:
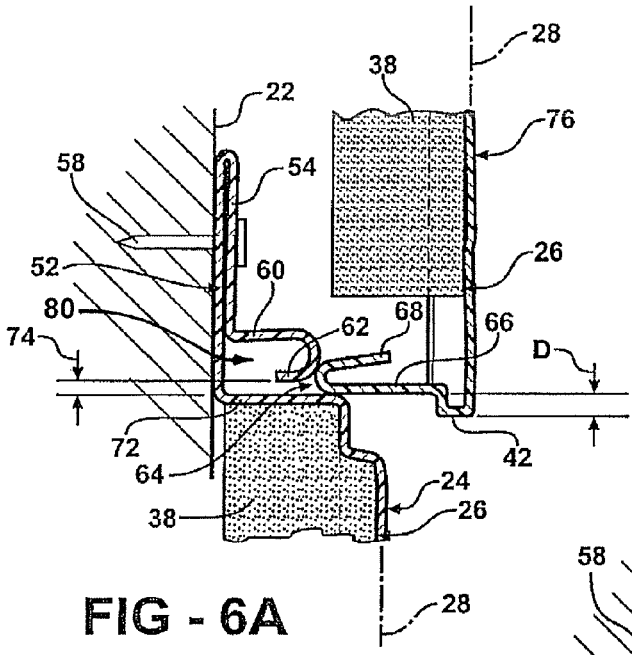
FIG. 6A is an enlarged cross-sectional view of the first panel and the second panel of FIG. 1 with the first panel having a first locking element spaced from and aligned with a fourth locking element of the second panel prior to interlocking the first panel and the second panel.

As best shown in FIG. 2, the panel 24 also includes a spacer 72 integrally formed with and interconnecting the first locking element 52 and the body 26 for spacing the top edge 40 of the body 26 from the support surface 22 such that the plane 28 is substantially parallel with the support surface 22. It is to be appreciated that the term "substantially parallel" as used herein is an approximation and the plane 28 is considered to be substantially parallel to the support surface 22 when the panel 24 is attached to present an appearance of a straight wall. For example, in the embodiments shown in the Figures, the plane 28 is substantially parallel to the support surface 22 to present an appearance of a brick wall. Referring to FIG. 6A, the first arm 60 and the spacer 72 define a receiving space 80 therebetween, into which first finger 62 extends from the first arm 60.

The spacer 72 has a length which is complementary to the length of the second locking element 64 such that the combined spacing provided by the spacer 72 and the second locking element 64 results in the plane 28 of the panel 24 being parallel to the support surface 22. Typically, the length of the spacer 72 is greater than the length of the first arm 60 of the first locking element 52 for recessing the first arm 60 relative to the plane 28. The first locking element 52 and the spacer 72 define a gap 74 therebetween. It is to be appreciated that the first locking element 52 may contact the spacer 72 while still defining the gap 74.

Referring to FIG. 1, the siding system 20 includes a second panel 76. It is to be appreciated that the panel 24 discussed above may also be referred to as a first panel 24. The first panel 24 and the second panel 76 are substantially similar to each other such that the second panel 76 contains all the features of the first panel 24 discussed above. Typically the first panel 24 and the second panel 76 are disposed vertically adjacent to each other on the support surface 22. It is to also be appreciated that the first locking element 52 and the second locking element 64 discussed above may also be referred to as a third locking element and the fourth locking element, respectively, when disposed on the second panel 76. It is to be further appreciated that the body 26 and the plane 28 discussed above may also be referred to as a first body and a first plane, respectively, when disposed on the first panel 24. Additionally, it is to be appreciated that body 26 and the plane 28 discussed above may also be referred to as a second body and a second plane, respectively, when disposed on the second panel 76.

Figure 6B:
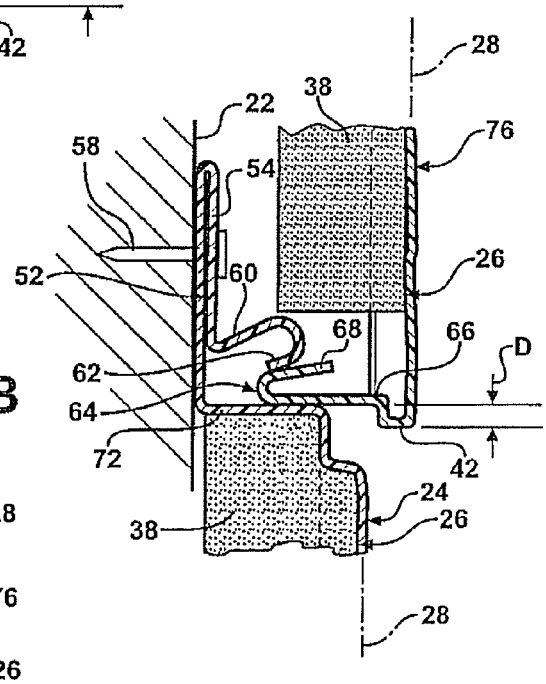
FIG. 6B is an enlarged cross-sectional view of the first panel and the second panel of FIG. 1 with the fourth locking element of the second panel partially disposed within a gap of the first panel.
Figure 6C:
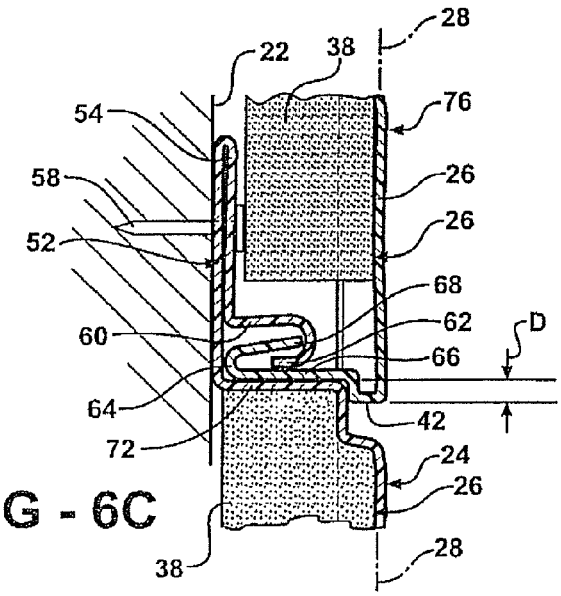
FIG. 6C is an enlarged cross-sectional view of the first panel and the second panel of FIG. 1 with the fourth locking element of the second panel fully engaging the first locking element of the first panel to secure the second panel to the first panel.

Below is a discussion of how to assemble the first panel 24 and the second panel 76. Referring back to FIGS. 1 and 2, the first panel 24 and the second panel 76 engage each other and are mounted to the support surface 22. As shown in FIG. 6A, the first panel 24 is mounted to the support surface 22 and subsequently the second locking element 64 of the second panel 76 is aligned with the gap 74 of the first panel 24 and, as shown in FIGS. 6A-6C, is received into the receiving space 80 defined between the spacer 72 and the first arm 60 of the first locking element 52, along a direction substantially perpendicular to the first plane 28 of the first panel 24. As shown in FIG. 6B, typically, the second locking element 64 of the second panel 76 is disposed within the gap 74 of the first panel 24 by applying a force to the bottom edge 42 of the second panel 76. The second locking element 64 of the second panel 76 contacts the first locking element 52 of the first panel 24 for forcing the first arm 60 from the normal position to the biased position to allow the second locking element 64 of the second panel 76 to interlock with the first locking element 52 of the first panel 24 for interlocking the panels 24, 76.

Generally, the first locking element 52 of the first panel 24 is for engaging with the second panel 76. Referring to FIG. 6C, after the second finger 68 of the second locking element 64 of the second panel 76 passes the first finger 62 of the first locking element 52 of the first panel 24 the first arm 60 returns to the normal position thereby resulting in the interlocking of the first finger 62 of the first panel 24 with the second finger 68 of the second panel 76. It is to be appreciated that the first locking element 52 of the first panel 24 may remain in between the normal position and the biased position instead of returning to the normal position once the first locking element 52 and the second locking element 64 interlock. It is also to be appreciated that the first panel 24 and the second panel 76 may be interlocked by other methods known in the art, such as sliding the second locking element 64 of the second panel 76 within the first locking element 52 of the first panel 24.

The interlocking of the first locking element 52 of the first panel 24 with the second locking element 64 of the second panel 76 provides a strong locking engagement between the first panel 24 and the second panel 76 for preventing separation between the first panel 24 and the second panel 76. More specifically, separation between the first panel 24 and the second panel 76 is avoided by the interaction of the second locking element 64 of the second panel 76 with the first locking element 52 and panel 24. It is to be appreciated that the first locking element 52 and the second locking element 64 may be configured in a variety of ways so long as the first locking element 52 and the second locking element 64 interlock with each other.

As discussed above the first arm 60 is recessed from the first plane 28 which requires the second locking element 64 of the second panel 76 to extend through the first plane 28 of the first panel 24 to interlock with the first locking element 52 of the first panel 24. The spacer 72 of the first panel 24 is provided for spacing the top edge 40 of the first body 26 from the support surface 22 and the spacer 72 of the second panel 76 is provided for spacing the top edge 40 of the second body 26 from the support surface 22 such that the plane 28 of the first panel 24 is aligned with the plane 28 of the second panel 76 when the panels 24, 76 are interconnected. Additionally, the spacer 72 of the first panel 24 and the second panel 76 allow for orientating the panels 24, 76 in a substantially parallel relationship to the support surface 22. It is to be appreciated that the term "substantially parallel" as used herein also provides for the plane 28 of the first panel 24 and the panel 28 of the second panel 76 being slightly angled relative to each other without departing from the nature of the invention.

It is to be appreciated that the siding system 20 may further include a third panel 78. The first panel 24 and the third panel 78 are substantially similar to each other such that the third panel 78 contains all the features of the first panel 24 discussed above. Referring back to FIGS. 3, 4 and 5, the third panel 78 is positioned in front of the overlapping portion 48 of the first panel 24 so that the left end 46 of the third panel 78 abuts the right end 44 of the first panel 24 when the panels 24, 76 are mounted to the support surface 22. The third panel 78 is disposed over the overlapping portion 48 of the first panel 24 for presenting a continuous appearance of the siding system 20. The decorative elements 34 of the first panel 24 and the second panel 76 cooperate to define the void 36 resembling the grout line.

Typically, the third panel 78 is disposed over the overlapping portion 48 of the first panel 24 prior to mounting the second panel 76 to the support surface 22. Referring to FIG. 5, as discussed above the second locking element 64 may define the second cut out 70 adjacent to the right end 44 for allowing the third panel 78 to overlap the first panel 24.

It is to be appreciated that the siding system 20 typically includes a plurality of panels such that the siding system 20 described above is repeated until the support surface 22 is covered.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention.

The invention claimed is:

1. A siding system for covering a support surface, said siding system comprising:

a first panel including a first body having opposing top and bottom edges and defining a first plane, a first locking element integrally formed with said first body and interconnected to said top edge of said first body, and a second locking element integrally formed with said first body and attached to said bottom edge of said first body for spacing said bottom edge of said first panel from the support surface;

a second panel including a second body having opposing top and bottom edges and defining a second plane, a third locking element integrally formed with said second body and interconnected to said top edge of said second body, and a fourth locking element integrally formed with said second body and attached to said bottom edge of said second body for spacing said bottom edge of said second panel from the support surface with said first locking element engaging said forth fourth locking element to interlock said panels; and characterized by a first spacer integrally formed with and interconnecting said first locking element and said first body for spacing said top edge of said first body from the support surface and a second spacer integrally formed with and interconnecting said third locking element and said second body for spacing said top edge of said second body from the support surface such that said first plane is aligned with said second plane when said panels are interconnected and for orientating said panels in a substantially parallel relationship to the support surface, and by said first locking element including a first arm generally transverse to said first plane, a receiving space being defined between said first spacer and said first arm, and by said fourth locking element being receivable into said receiving space along a direction substantially perpendicular to said first plane.

2. A siding system as set forth in claim 1 wherein said first spacer and said second spacer each have a length substantially equal to each other.

3. A siding system as set forth in claim 2 wherein said second locking element and said fourth locking element each have a length complementary to said length of said spacers.

4. A siding system as set forth in claim 1 wherein said first locking element includes a portion that is substantially parallel with said first plane and a first finger extending from said first arm into said receiving space with said first arm and said first finger presenting a general hook shaped configuration and wherein said fourth locking element is transverse to said second plane and includes a fourth arm having a fourth finger with said fourth arm and fourth finger presenting a complementary configuration to said first arm and said first finger.

5. A siding system as set forth in claim 4 wherein said first arm has a normal position and a biased position such that said fourth locking element contacts said first locking element for forcing said first arm from said normal position to said biased position to allow said fourth locking element to interlock with said first locking element.

6. A siding system as set forth in claim 1 wherein each of said first locking element and said third locking element define a plurality of holes for receiving a plurality of fasteners to secure said panels to the support surface.

7. A siding system as set forth in claim 1 wherein said first body and said second body each presents a decorative face opposed by a rear face such that said rear face is adjacent to the support surface when said panels are mounted to the support surface.

8. A siding system as set forth in claim 7 wherein each of said panels further includes an overlapping portion extending from said body with said overlapping portion recessed from said decorative face.

9. A siding system as set forth in claim 8 wherein said overlapping portion defines a cutout in said panel for presenting a staggered appearance of said overlapping portion.

10. A siding system as set forth in claim 7 further including a third panel disposed over the overlapping portion of said first panel for presenting a continuous appearance.

11. A siding system as set forth in claim 7, wherein said decorative face of each of said panels defines a plurality of decorative elements that cooperate to resemble a brick wall.

12. A siding system as set forth in claim 7, wherein said decorative face of each of said panels defines a plurality decorative elements that cooperate to resemble a stone wall.

13. A siding system as set forth in claim 1, wherein said first panel and said second panel each comprise a rigid thermoplastic material.

14. A siding system as set forth in claim 13, wherein said rigid thermoplastic material is polyvinylchloride.

15. A siding system as set forth in claim 1, wherein each of said panels further includes a backing element disposed on said body such that said backing element is between said body and said support surface when said panel is mounted to the support surface for providing rigidity to said panels and for insulating the support surface.

16. A panel for use in a siding system to cover a support surface with the siding system including a second panel, said panel comprising:

a body having opposing top and bottom edges and defining a plane, a first locking element integrally formed with said body and interconnected to said top edge of said body for engaging with the second panel;

a second locking element integrally formed with said body and attached mounted to said bottom edge of said body for spacing said bottom edge of said body from the support surface; and characterized by a spacer integrally formed with and interconnecting said first locking element and said body for spacing said top edge of said body from the support surface such that said plane is substantially parallel with the support surface, and by said first locking element including a first arm generally transverse to said plane, a receiving space being defined between said spacer and said first arm into which a portion of the second panel is receivable along a direction substantially perpendicular to said plane.

17. A siding system as set forth in claim 16 wherein said spacer has a length and said second locking element has a length complementary to said length of said spacer.

18. A siding system as set forth in claim 16 wherein said first locking element includes a portion that is substantially parallel with said plane and a first finger extending from said first arm into said receiving space with said first arm and said first finger presenting a general hook shaped configuration and wherein said second locking element is transverse to said plane and includes a second arm having a second finger with said second a and second finger presenting a complementary configuration to said first arm and said first finger.

19. A siding system as set forth in claim 16 wherein said first locking element defines a plurality of holes for receiving a plurality of fasteners to secure said panel to the support surface.

20. A siding system as set forth in claim 16 wherein said body presents a decorative face opposed by a rear face such that said rear face is adjacent to the support surface when said panel is mounted to the support surface.

21. A siding system as set forth in claim 20 wherein said panel further includes an overlapping portion extending from said body with said overlapping portion recessed from said decorative face.

22. A siding system as set forth in claim 21 wherein said overlapping portion defines a cutout in said panel for presenting a staggered appearance of said overlapping portion.

23. A siding system as set forth in claim 20, wherein said decorative face of said panel defines a plurality of decorative elements that cooperate to resemble a brick wall.

24. A siding system as set forth in claim 20, wherein said decorative face of said panel defines a plurality of decorative elements that cooperate to resemble a stone wall.

25. A siding system as set forth in claim 16, wherein said panel comprises a rigid thermoplastic material.

26. A siding system as set forth in claim 25, wherein said rigid thermoplastic material is polyvinylchloride.

27. A siding system as set forth in claim 16, wherein said panel further includes a backing element disposed on said body such that said backing element is between said body and the support surface when said panel is mounted to the support surface for providing rigidity to said panel and for insulating the support surface.

* * * * *

UNITED STATES PATENT AND TRADEMARK OFFICE

CERTIFICATE OF CORRECTION

PATENT NO. : 8,136,323 B2
APPLICATION NO. : 12/188349
DATED : March 20, 2012
INVENTOR(S) : Daniel W. King It is certified that error appears in the above-identified patent and that said Letters Patent is hereby corrected as shown below:

IN THE CLAIMS:

Column 7, line 47, claim 1, please delete the word "forth" from the second clause of Claim 1.

Column 8, line 65, claim 16, please delete the word "mounted" from the third clause of Claim 16.

Column 9, line 21, claim 18, the text "said second a and" should be replaced with --said second arm and-- such that the portion of Claim 18 in column 9, lines 21-22 reads: said second arm and second finger presenting a complementary configuration to said first arm and said first finger.

Signed and Sealed this
Third Day of July, 2012

David J. Kappos

David J. Kappos
*Director of the United States Patent and Trademark Office*